US008746659B2

(12) United States Patent
Cardona

(10) Patent No.: US 8,746,659 B2
(45) Date of Patent: Jun. 10, 2014

(54) DEVICE FOR OPENING A PULL DOOR BY APPLYING A PRESSURE

(75) Inventor: Yvan Cardona, Perpignan (FR)

(73) Assignee: Libervit, Perpignan (FR)

( * ) Notice: Subject to any disclaimer, the term of this patent is extended or adjusted under 35 U.S.C. 154(b) by 179 days.

(21) Appl. No.: 13/266,811

(22) PCT Filed: Mar. 12, 2010

(86) PCT No.: PCT/FR2010/050432

§ 371 (c)(1),
(2), (4) Date: Jan. 31, 2012

(87) PCT Pub. No.: WO2010/125263

PCT Pub. Date: Nov. 4, 2010

(65) Prior Publication Data

US 2012/0119174 A1 May 17, 2012

(30) Foreign Application Priority Data

Apr. 28, 2009 (FR) ..... 09 52763

(51) Int. Cl.

| | |
|---|---|
| ***A62B 3/00*** | (2006.01) |
| ***B66F 3/24*** | (2006.01) |
| ***E21D 15/44*** | (2006.01) |
| ***B66F 3/00*** | (2006.01) |
| *B25B 28/00* | (2006.01) |

(52) U.S. Cl.
USPC ..... 254/93 R; 254/14

(58) Field of Classification Search
USPC ..... 254/93 R, 14, 133 R
See application file for complete search history.

(56) References Cited

U.S. PATENT DOCUMENTS

| | | | | |
|---|---|---|---|---|
| 4,270,733 | A * | 6/1981 | DePue | 254/93 R |
| 4,762,304 | A * | 8/1988 | Hill | 254/93 R |
| 4,783,053 | A * | 11/1988 | Yirmiyahu et al. | 254/93 R |
| 4,890,818 | A | 1/1990 | Williams | |
| 5,810,333 | A * | 9/1998 | Hickerson et al. | 254/93 R |
| 6,746,183 | B1 * | 6/2004 | Sullivan | 405/272 |
| 6,916,013 | B2 * | 7/2005 | Cardona | 254/93 R |
| 7,798,470 | B2 * | 9/2010 | McLoughlin et al. | 254/133 R |
| 8,282,076 | B2 * | 10/2012 | Takahashi | 254/14 |
| 2004/0149969 | A1 * | 8/2004 | Cardona | 254/93 R |

FOREIGN PATENT DOCUMENTS

| | | |
|---|---|---|
| FR | 2 825 354 A1 | 12/2002 |
| GB | 2 236 803 A | 4/1991 |

* cited by examiner

*Primary Examiner* — Lee D Wilson
*Assistant Examiner* — Alvin Grant
(74) *Attorney, Agent, or Firm* — Lucas & Mercanti, LLP

(57) ABSTRACT

A device for opening a door by staving it inwards, so that the device can exert a trust on the vertical surface of the door and stave it inwards when the device is positioned against the door on the side to which it opens by being pulled, the device comprising an actuator, an intermediate soleplate, and an upper jacking bar, the device comprising an upper jacking device fixed in a hinged manner to the upper end of the upper jacking bar, and comprising at least one wedging and locking device forming: a front flat portion, a riser portion, and a rear portion.

12 Claims, 7 Drawing Sheets

DEVICE FOR OPENING A PULL DOOR BY APPLYING A PRESSURE

This application is a 371 of PCT/FR2010/050432 filed Mar. 12, 2010, which in turn claims the priority of FR 0952763 filed Apr. 28, 2009, the priority of both applications is hereby claimed and both applications are incorporated by reference herein.

BACKGROUND OF THE INVENTION

The present invention relates to a device for exerting thrust on the vertical surface of a door to open it by staving said door in. The present invention also relates to a method of exerting a thrust, preferably of at least 50 kN [kilonewton], on a door or any other vertical planar surface from external jacking points.

More particularly, the invention relates to a device for forcibly opening as rapidly as possible, without impact and in silence, any type of door in a dwelling, or in industrial or other premises.

Such devices are primarily intended for use either by emergency services such as fire departments or rescue services, or by specialized police units.

FR 2 825 354 discloses devices of that type, which comprise:

- an actuator, preferably hydraulic, an intermediate soleplate and an upper jacking bar;
- said actuator comprising a movable rod with one end fixed in hinged manner, preferably detachably, to said intermediate soleplate; and said upper jacking bar being fixed in hinged manner, again preferably detachably, by one of its ends to said intermediate soleplate.

The hinging of the end of the movable rod of said actuator on said intermediate soleplate means that it can be inclined, preferably at 20° to 35° to the vertical, in order to be able to exert thrust, preferably of at least 50 kN, on said intermediate soleplate when said intermediate soleplate is pressed against said door or said vertical planar surface and when said actuator presses against a lower external jacking point, preferably on the ground.

Similarly, the hinging of said upper jacking bar on said intermediate soleplate means that said bar can be disposed substantially vertically so that its free end can be applied directly to an upper external jacking point, preferably constituted by the frame of said door, as can be seen in FIG. 1A, or a ceiling, or a horizontal flat surface located above said vertical planar surface. The term "free end" as used here means the end of said bar that is not fixed to said intermediate soleplate.

That device is ideally suited to opening doors that open by pushing on the side on which the door opening device is located, i.e. doors termed "push" doors that open into the inside of a room that is to be entered from its outside.

In practice, the device functions on push doors by pressing against three points, namely:

- the ground;
- on the door; and on the upper portion or lintel of the frame retaining the door and against which the door abuts.

The upper end of the upper jacking bar abuts below and against the portion of the lintel of the door frame that projects relative to the vertical plane of the surface of the door and against which the upper end of the door abuts. That portion of the lintel, which is lower than the upper end of the door, retains the door in its frame when the door is closed by pulling it.

In contrast "pull" type doors, i.e. doors that open by being pulled outwards from the room that is to be entered from the outside, do not have the same door frame configuration. On the side outside the room, there is no upper bearing portion projecting from the door frame against which the upper end of the upper jacking bar could press.

Furthermore, the inventors have discovered that this absence of a door frame retainer and abutment on the outside of the door, for pull doors, gives rise to a second problem in the operation of the door forcing device described above. When the upper bar of the device inclines when the door starts to stave in at the intermediate soleplate, namely substantially at mid-height, the upper end of the door is not retained, and so the central thrust at the intermediate soleplate is less effective in staving in the door, thus slowing down opening of the door.

BRIEF SUMMARY OF THE INVENTION

The aim of the present invention is to provide a novel device for forcing a door with a vertical planar surface, which device is suitable for a pull door, i.e. a door that is to be opened from the outside, with the retaining bead of the door frame being located on the inside.

More particularly, one aim of the present invention is to provide a device for forcing and staving in a pull door, which device provides a solution to the problem set out above.

To this end, the present invention provides a device for opening a door by staving it in, which device can exert a thrust on the vertical surface of the door and stave it in when the device is positioned against the door on the side to which it opens by being pulled, the device comprising:

- a preferably hydraulic actuator, an intermediate soleplate, and an upper jacking bar;
- said actuator comprising a movable rod with one end fixed in hinged manner, preferably detachably, on said intermediate soleplate; and said upper jacking bar being fixed in hinged manner, preferably detachably, by one of its ends to said intermediate soleplate;
- the device being characterized in that it comprises an upper jacking device fixed in hinged manner, preferably detachably, to the upper end of said upper jacking bar, said upper jacking device comprising at least one wedging and locking device forming:
- a front flat portion that can be introduced into a slit between the door frame and the upper end of the door; and
- a riser portion extending in a longitudinal direction YY' perpendicular to said front flat portion and above it, the upper end of said riser portion being intended to face the partition above the door frame, and preferably said riser portion extending over a length equal to at least three times the dimension of said front flat portion in the direction XX' perpendicular to said longitudinal direction YY' of said riser portion; and
- a rear portion located at the base of and behind said riser portion, at the underside of which a fixing element is capable of allowing pivotal hinging of said wedging and locking part relative to the upper end of said upper jacking bar, said rear portion preferably being a rear flat portion extending in a direction XX' perpendicular to said longitudinal direction YY' of said riser portion.

When said front flat portion is introduced into said slit between the door frame and the upper end of the door, said riser portion extending above said door frame with its upper end facing the partition above said frame, and when the actuator of the forcing device of the invention is activated, the effect of said intermediate soleplate staving in the central portion of the door is that the surface of the door is inclined and the upper end of the door starts to move back out of the frame. This backward movement is, however, limited since the effect of the upward thrust on the upper end of the upper jacking bar on the underside of said front flat portion causes the front end of said front flat portion to pivot, which then swings downwards and presses against the upper section of the door. At the same time, said riser portion is inclined relative to the vertical because its base swings rearwards. However, its upper end abutting against the partition above the door frame prevents the upper end of the door from moving further back. Said wedging and locking device thus has the same technical effect as the portion of the lintel projecting relative to the vertical plane of the door acting as an abutment in a door opening device that does not have said locking and wedging device at the upper end of the upper jacking bar, when the door opening device is located on the side of the door that opens by pushing.

The term "flat portion" as used here means that said flat portion has upper and lower faces extending essentially parallel in planes perpendicular to the longitudinal direction YY'. In addition, it should be understood that said front flat portion extends forwardly from said riser portion, and said rear flat portion extends rearwardly from said riser portion, i.e. in two opposed directions of the direction XX' perpendicular to the longitudinal direction YY' either side of said riser part and at the base thereof, i.e. on its lower end side.

It should in fact be understood that:

- the terms "upper/lower" and "above"/"at the underside" refer to two opposed orientations in the longitudinal direction YY', the expression "at the base" meaning on the lower end side; and
- the terms "front" and "rear" refer to two opposite orientations in the direction XX' perpendicular to the longitudinal direction YY'.

The actuator is intended to press against the ground, but could also press against a lower external jacking point. Similarly, the intermediate soleplate is intended to press against the door, but could press against a middle external jacking point.

It should be understood that said front flat portion, riser portion, and rear flat portion are unitary and thus consist of a single piece.

Preferably, these various portions of said wedging part are made of steel or of aluminum.

The term "in hinged manner" as used here means that the two parts fixed to each other can pivot relative to each other at least about a horizontal axis when the longitudinal directions of said lower jacking bar and upper jacking bar are located in the same vertical plane.

In a preferred embodiment, the upper end of said riser portion of the wedging part comprises or cooperates with a bearing part having a bearing surface extending in a plane YY',ZZ' perpendicular to the upper and lower faces of said front flat portion and can come into contact and press against the vertical partition above the door frame, when said front flat portion is introduced horizontally and forced as far as possible into said slit between the upper end of the door and the door frame, said bearing surface having a dimension that is greater than the surface of the upper portion of said riser portion, on which said bearing part is fixed.

Said bearing surface can be used to increase the contact area between said riser portion and said partition and thus can reduce the bearing pressure on the partition and avoid damaging it or even causing the upper end of said riser portion to break and/or can avoid staving in the partition, which would mean that complete staving in of the door might not be accomplished.

The increase in the distance of said bearing part relative to the base of said riser portion and the increase in the weight of said bearing part means that the moment of the forces transferred to the upper end of the door, and hence pivoting thereof, can be increased relative to an axis located at the upper end of the riser portion abutting the partition is prevented. Thus, the cantilever effect of said riser part preventing the complete retraction of the upper end of the door out of its frame under the effect of the thrust of the intermediate soleplate by the action of the actuator of said lower jacking bar can be prevented. This complete retraction would have a deleterious effect on the efficiency and rapidity of staving in and opening the door.

More particularly, said bearing surface is located vertically in front of said riser portion such that only said bearing surface is in contact with the partition above the door frame when said front flat portion is inserted horizontally into said slit.

It should be understood that the remainder of said riser portion located below said bearing surface is set back relative to the partition and thus is not in contact therewith.

Because of this offset, it is possible to fit the jacking device of the invention even in the presence of a peripheral molding facing the door frame on the side of the partition on which the thrust is exerted, such that said bearing surface is located in front of said riser portion of the wedging part by a distance at least equal to the thickness of said molding.

More particularly still, said bearing part may be fixed to the upper end of said riser portion in two different positions, wherein the distance between said bearing surface and the front face of said riser portion is different, the two said positions corresponding to inversion of the faces constituting the front face and rear face of the bearing part relative to the upper end of said riser part on which said bearing part is fixed.

Hence, it should be understood that it is possible to obtain several values for the distance between the partition and said riser part and thus to accommodate the possibility that moldings with two different depths are present on the door frame.

It should be understood that the distance between said bearing surface and said riser portion is a distance in a direction perpendicular to the longitudinal direction of said riser portion.

More advantageously, said front flat portion comprises:

- a front end beveled on its underside at an angle of approximately 30°, facilitating insertion of said front flat portion into said slit; and
- an upper grooved or corrugated face, said grooves or corrugations being capable of being inclined rearwardly; and
- a lower face comprising at least one corrugation or a portion in the form of a rearwardly inclined hook.

It should be understood that said grooves or corrugations of the upper grooved or corrugated face are inclined rearwardly so that they do not impede introduction of said front flat portion into said slit and so that they increase the initial adhesion to the facing frame surface, in the event of rearward movement of said upper face.

Similarly, it should be understood that said hook on the underside of said front flat portion allows it to be forced into the upper section of the door when said front flat portion inserted in said slit is subjected to a rearward retracting movement, with its front end pressing against said section of the door by pivoting downwardly, without becoming an obstacle to the introduction of said front flat portion into said slit.

This type of pivoting downwards movement of the front end of the front flat portion results from the upward thrust of the upper end of the upper bar behind and on the underside of said front flat portion and on the underside of said rear flat portion.

Said corrugation or hook at the underside of said front flat portion prevents the front flat portion from becoming completely disengaged from said slit under the effect of the upwards thrust of the upper portion of the upper jacking bar and excessive inclination of the riser part relative to the partition before the upper end thereof presses against said partition either directly or indirectly.

In another preferred embodiment, said wedging and locking part comprises or cooperates with a striking part in the form of a block constituting an anvil located at the base of said riser portion, at least partially above said rear flat portion, said anvil-forming striking part being detachably fixed on said wedging part.

Said anvil-forming block is suitable for being hit with a mallet in order to insert said front flat portion into said slit between the upper end of the door and the frame, without damaging said wedging part and in particular the base of said riser portion.

Preferably, said part forming an anvil block is detachable and may be replaced should it deteriorate with use.

More preferably, said bearing part and said anvil block are made of aluminum so that the device of the invention does not become too heavy.

More particularly, said front flat portion and said riser portion of the locking part have the same dimension in a direction ZZ' perpendicular to said longitudinal direction YY' of said riser portion, preferably with a width of less than 100 millimeters (mm), more preferably a width of 30 mm to 70 mm.

These dimensions are sufficient to constitute an effective bearing surface without creating bulk, which would render transport and/or positioning of the jacking device and the thrust device of the invention more difficult.

Other particular and advantageous characteristics of the device of the invention include:

- a lower soleplate, the other end of said actuator being fixed in hinged manner, preferably detachably, to said lower soleplate; and
- said actuator is a double-acting actuator comprising an actuator body constituted by a cylindrical chamber comprising two movable rods that can exert thrusts oriented in opposite directions to each other, the ends of said movable rods on the external side of said cylindrical chamber being connected in hinged manner, preferably detachably, to said intermediate and lower soles respectively; and
- said upper jacking bar is adjustable in length, preferably constituted by two telescopic tubes, the length of said jacking bar being adjustable by locking the relative position of said telescopic tubes; and
- said intermediate soleplate comprises a flat support one face of which, which is intended to press against said door or vertical planar surface, comprises non-slip elements, preferably hard tips, and the other face of which comprises means for hinging said actuator and said upper jacking bar.

This feature means that the device of the invention can be adapted to doors with different heights and can also reduce the bulk of the device once stowed.

Still more particularly, said device comprises:

- a hydraulic power supply delivering a pressure, preferably of at least 250 bar, more preferably mounted on a frame structure that can be carried on the back of an operator; and
- said hydraulic power supply preferably being connected via a single flexible hose to a single-acting hydraulic actuator, more preferably via a handle that can control opening and closing of supply and return hydraulic fluid valves of said single-acting hydraulic actuator.

Since the device of the invention only has to work over limited periods, it is possible to incorporate batteries that are small and thereby obtain a portable device that is lightweight and compact.

The present invention also provides a method of exerting a thrust, preferably of at least 50 kN, on a pull door, characterized in that a device in accordance with the invention is used and in that the following steps are carried out:

1) said front flat portion is inserted in a slit between the upper end of the door and the door frame, forcing it in as far as possible until the base of said riser portion abuts against the door frame or a molding facing the door frame; and 2) said actuator is disposed, preferably at an inclination of 20° to 35° relative to the vertical, with

- said intermediate soleplate pressing against said door or vertical planar surface;
- said actuator pressing against a lower external jacking point, preferably via a said lower soleplate; and 3) the movable rod of said actuator is extended so as to exert said thrust on said intermediate soleplate until the inclination of said actuator is increased by an angle of at least 3°, and preferably is increased by 5° to 20°.

Other characteristics and advantages of the present invention become apparent from the following detailed description made with reference to the accompanying drawings:

DESCRIPTION OF A PREFERRED EMBODIMENT

Figure 1B:
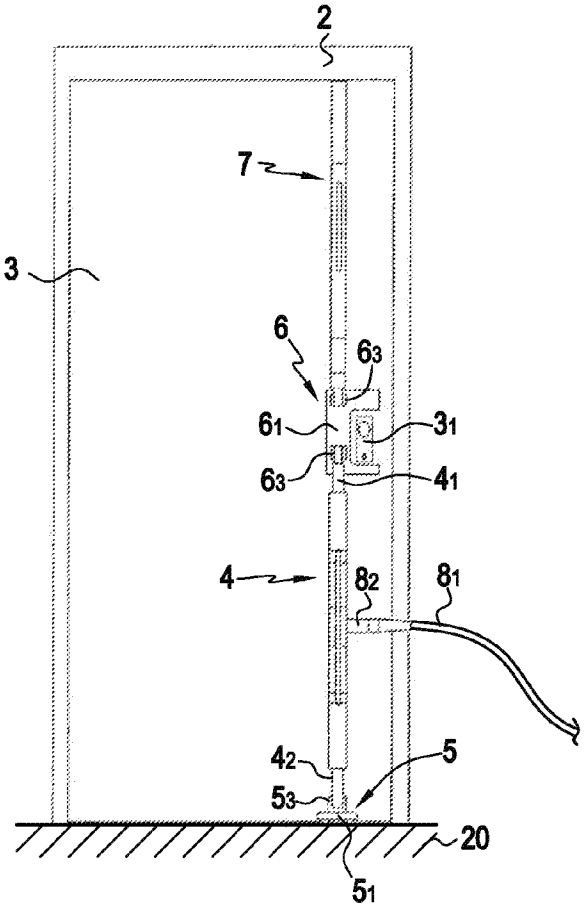
FIG.1B PRIOR ART
FIGS. 1A, 1B and 1C illustrate a prior art device for exerting a thrust on a push door.
Figure 1A:
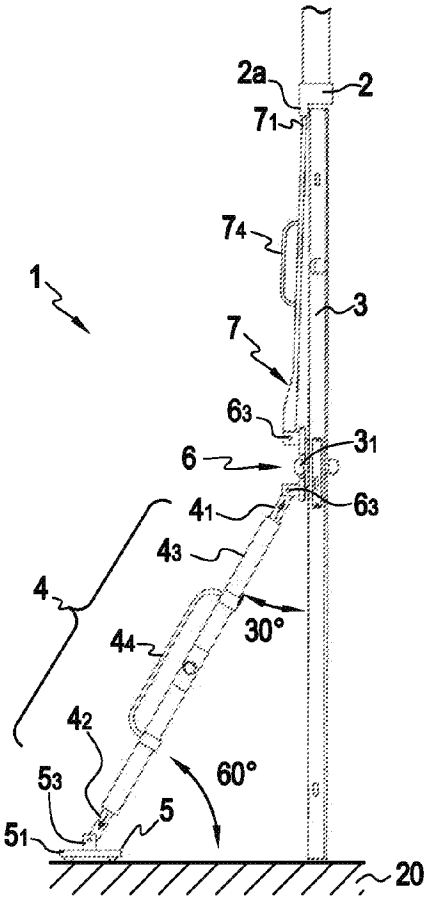
FIG.1A PRIOR ART
Figure 1C:
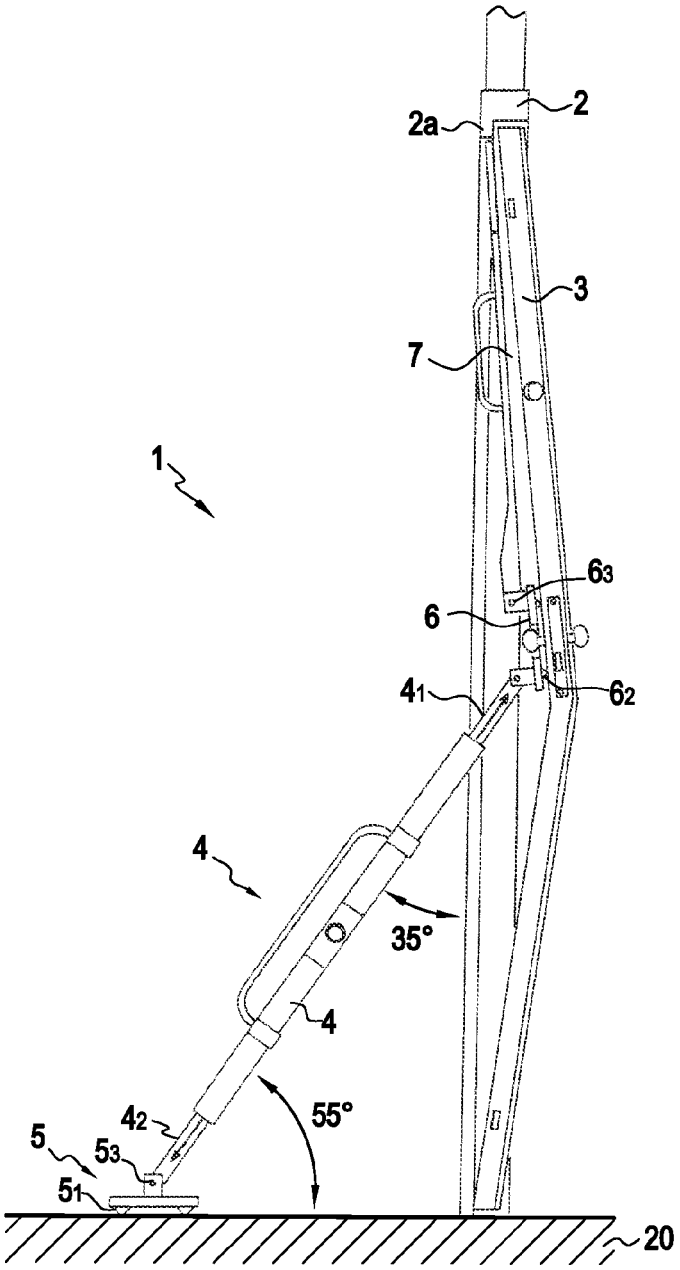

FIGS. 1A, 1B and 1C show a prior art device for forcing and staving in a door adapted for push doors, which device includes all of the components of the device of the invention adapted for pull doors, except for the upper jacking device 10 that is fixed in hinged manner to pivot at the upper end 7-1 of the upper jacking bar 7.

In the prior art device, it can be seen that the upper end 7-1 of the upper jacking bar 7 presses directly against the underside of the vertical portion 2*a* of the lintel of the frame 2 forming an abutment for retaining the door 3 on the outside where the forcing device of the invention is located.

The device of the invention as described in FIGS. 2 to 7 further comprises an upper jacking device 10 and has the same components as for the device 1 of FIGS. 1A and 1C.

The upper jacking device 10 is pivotally hinged at the upper end $7_1$ of the upper jacking bar 7 by means of a hinge element 11 that comprises:

- in the upper portion, a bracket 11*b* comprising two arms 11*b*-1, 11*b*-2, each being perforated with an orifice 11*c*; and
- in its lower portion, a hollow tube 11*a* the interior of which is adapted to the upper end $7_1$ of the upper tube of the upper jacking bar 7;
- said orifices 11*c* having the same axis ZZ', if necessary horizontal, perpendicular to the rise direction of the arms 11*b*-1, 11*b*-2 and to the longitudinal axial direction of the tube 11*a*, thus allowing pivotal hinging about the axis of said orifice 11*c* of the wedging part 12 described below, in a plane passing through the longitudinal axis of the upper jacking bar 7.

The upper jacking device 10 comprises a wedging and locking part 12 comprising the following portions forming a single steel part.

A front flat portion 12*a* forming a pawl that is inserted into the slit 3*a* between the upper lintel of the door frame 2 and the upper section $3_1$ of the door 3.

Said front flat portion 12*a* comprises a front end 12*a*-1, which on the underside is beveled to the rear at an angle of approximately 30°, to facilitate insertion. Thus, the rear lower end of the bevel arrives at the level of the front end of the underside of said front flat portion 12*a* forming a pawl; said rear lower end of the bevel passes below said underside of said front flat portion and thus forms a hook 12*a*-3 therewith.

The upper face of said front flat portion 12*a* is grooved, 12*a*-2, the projecting portions of said grooves also being inclined rearwardly so that said grooves increase the initial adhesion of said front flat portion on the underside of the lintel of the door frame 2 without obstructing insertion of the pawl 12*a* into the slit 3*a*.

Figure 6B:
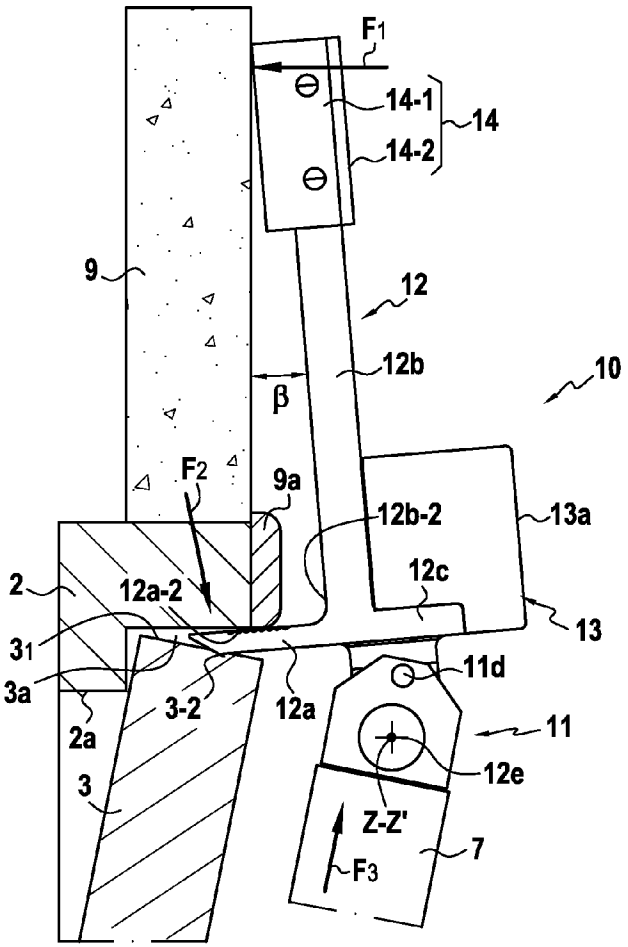
FIGS. 6A and 6B are sectional views of the jacking device 10 in position at the upper end of the door pressing against the partition before exerting the thrust via the actuator of the thrust device of the invention (FIG. 6A) and after starting to stave in the door (FIG. 6B)
Figure 7:
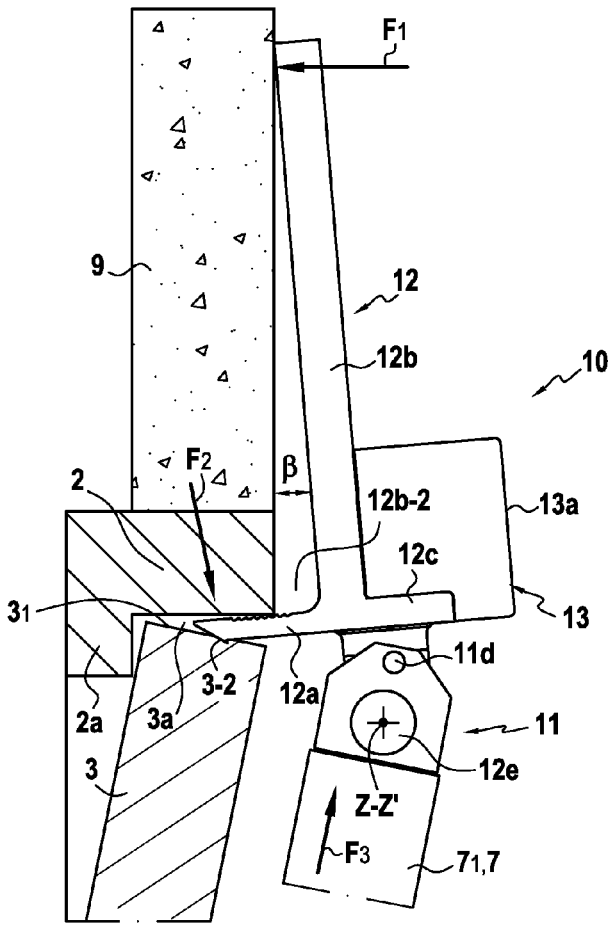
FIG. 7 represents a variation of the jacking device 10 with no bearing block 14, adapted for a partition without a molding facing the door frame.

As can be seen in FIGS. 6B and 7, when said front flat portion 12*a* is in position in the slit 3*a* and when, under the effect of the thrust of the actuator 4, the door 3 starts to stave in and the upper end $3_1$ of the door 3 starts to move back slightly, this causes the front flat portion 12*a* to start retracting rearwardly by a downward swing of the front end 12*a*-1 of the pawl 12*a* relative to the base 12*b*-2 of said riser portion 12*b*. Thus, the hook 12*a*-3 becomes embedded in the upper section $3_1$ of the door at $3_2$, which prevents said front flat portion 12*a* from continuing to become disengaged from the slit 3*a*. Because the upper bearing block 14 abuts against the partition 9, above the door frame 2 described below, the upper jacking device 10 of the invention offers resistance and blocks the rearward movement of the upper end $3_1$ of the door 3 out of the frame 2 when the thrust continues to be applied at the intermediate soleplate 6 to completely stave in the door 3.

The wedging and locking device 12 also comprises a rear flat portion 12*c* rearwardly of said front portion 12*a*, said rear flat portion 12*c* extending in the same substantially horizontal plane XX'-ZZ' beyond the slit 3*a* when the front flat portion 12*a* is inserted in the slit 3*a*.

This rear flat portion 12*c* comprises a lug 12*d* on its underside perforated at 12*f*, said lug 12*d* fitting between the two arms 11*b*-1, 11*b*-2 of the bracket 11*b* of the hinging element 11.

A fixing pin 12*e* is introduced into the orifices 11*c* then 12*f* with the same axis ZZ' substantially perpendicular to the axis XX' in which said front flat portion 12*a* and rear flat portion 12*c* extend, thereby allowing pivotal hinging of the locking device 12 about an axis ZZ' in a plane XX',YY', namely hinged to pivot in a vertical plane when said jacking device is in position with the front flat portion 12*a* inserted in the slit 3*a* between the frame 2 and the upper end of the door 3.

At the top of the arms 11*b*-1 and 11*b*-2 of the bracket 11*b*, ball screws 11*d* may be fitted, with the balls located in hollows 12*g* of the lugs 12*f*, having the effect of preventing the locking part 12 pivoting during transport of the thrust device 1 before it is used, if so desired.

Said front flat portion 12*a* and rear flat portion 12*b* extend over a distance of approximately 30 mm to 50 mm in each of the two directions ZZ' and XX'.

The wedging and locking device 12 further comprises a upper riser portion 12*b* extending in the vertical direction YY' perpendicular to the plane XX', ZZ' above said front flat portion 12*a* and rear flat portion 12*c*, said front flat portion 12*a* being located forward of the base 12*b*-2 of said riser portion 12*b* and in contrast, said rear flat portion 12*c* being located rearwardly of the base 12*b*-2 of said riser portion 12*b*.

Said front flat portion 12*a* and rear flat portion 12*c* have a thickness in the direction YY' of approximately 5 mm, said rear flat portion 12*c* possibly, however, being slightly thicker since it is not inserted in the slit 3*a*.

Said riser portion 12*b* separates the upper faces of said front flat portion 12*a* and rear flat portion 12*c*. Said riser portion 12*b* extends over a height of approximately 150 mm to 200 mm and forms a flat steel rod with the same width in the direction ZZ' of approximately 50 mm as said front flat portion 12*a* and rear flat portion 12*c*.

The thickness in the direction XX' of said riser portion 12*b* is at least twice, preferably three times the thickness of said front flat portion 12*a* and rear flat portion 12*c* such that said riser portion 12*b* is sufficiently rigid.

Figure 6A:
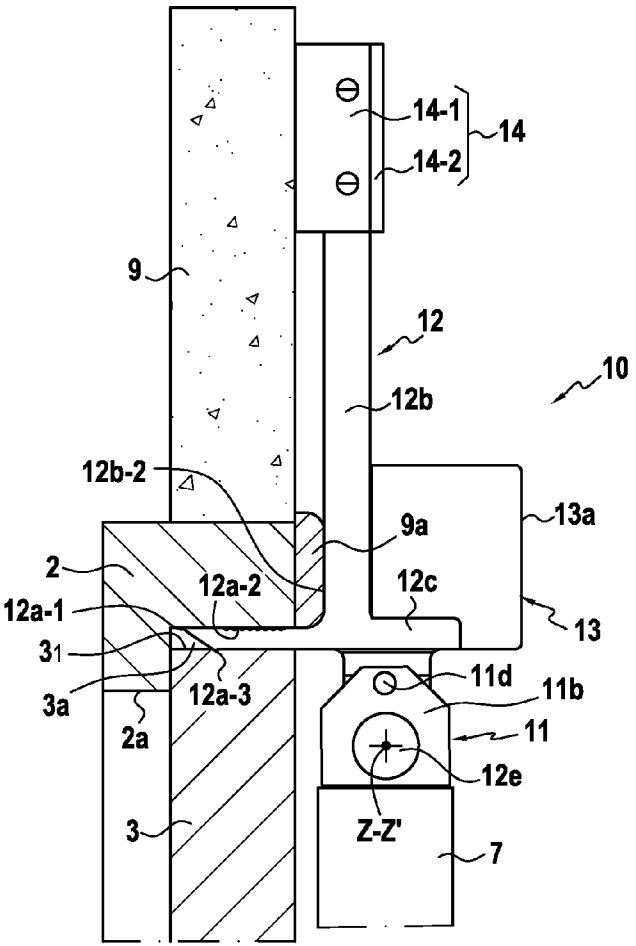

As can be seen in FIGS. 6A and 6B, the front face of the base 12*b*-2 of the riser portion 12*b* becomes wedged against a molding 9*a* facing the door frame 2 when said front flat portion 12*a* is inserted in the slit 3*a*. In a variation (FIG. 7), the door frame 2 does not have a molding, and the front face of the base 12*b*-2 of the riser portion 12*b* can be applied directly against the upper portion of the lintel of the frame 2 when the jacking device 10 does not have a bearing block 14 at the upper end 12*b*-1 of the riser portion 12*b*, as is described below.

In a preferred embodiment, the wedging and locking device 12 cooperates both at the upper end 12*b*-1 of the riser portion 12*b* with a bearing block 14 and also at said rear flat portion 12*c* with a striking block forming an anvil 13.

The bearing block 14 is formed by a first half-block $14_1$ and a second half-block $14_2$ that is thinner in the direction XX' than the first half-block, the two half-blocks being applied against each other by means of a screw 14*c* in a plane ZZ', YY', in order to form a rectangular block 14, with the upper end 12*b*-1 of the riser portion 12*b* being interposed between the two half-blocks $14_1$ and $14_2$.

The first half-block $14_1$ includes a recess 14*b* in one face that is shaped to receive the upper end 12*b*-1 of said riser portion 12*b* and can be used to fix it to the inside of said recess. The bearing block 14 is fixed to the upper portion 12*b*-1 of the riser portion 12*b* by screwing up using a screw 14*f* with the second half-block $14_2$ in the form of a plate against the face of the first half-block $14_1$ on the side of its recess and thus against the upper portion 12*b*-1 of the riser portion 12*b* inserted in said recess.

The bearing block 14 is in a non-symmetrical position in the direction XX' relative to the riser portion 12*b*.

The vertical flat front face 14*a* of the bearing block 14 is offset at the front by a distance of approximately 15 mm relative to the front face 12*b*-3 of the riser portion 12*b*, less than the thickness of the molding 9*a* so that when said front face of the base 12*b*-2 of the riser portion 12*b* is applied against the molding 9*a*, the front bearing area 14*a* of the bearing block 14 presses against the partition 9 above the door frame 2 after insertion of the front flat portion 12*a* in the slit 3*a* between the upper end $\mathbf{3}_1$ of the door and the upper portion of the frame 2.

For thinner moldings, the two-part configuration of the bearing block 14 can be used to reverse the respective positioning of the first half-block $\mathbf{14}_1$ and the second half-block $\mathbf{14}_2$. Since the second half-block $\mathbf{14}_2$ is thinner than the first half-block, the first half-block $\mathbf{14}_1$ is placed on the rear face 12*b*-4 of the upper portion 12*b*-1 of the riser portion 12*b* and the plate $\mathbf{14}_2$ against the front face 12*b*-3 of the upper portion 12*b*-1 of the riser portion 12*b*.

As can be seen in FIG. 6B, when the front end $\mathbf{3}_1$ of the door 3 starts to be forced and thus to be inclined at the start of actuating the actuator 4 of the device 1, this results in a slight retraction of the front flat portion 12*a* the hook 12*a*-3 of the lower face of which becomes embedded on the upper end section $\mathbf{3}_1$ of the door 3 at $\mathbf{3}_2$. However, this retraction is over a very limited distance, since the rod or riser portion 12*b* of the wedging and locking part 12 is sufficiently long so that its inclination relative to the vertical cannot exceed 5°. The upwards thrust force $F_3$ of the upper end $\mathbf{7}_1$ of the upper jacking bar 7 is transferred as a lateral forward force $f_1$ of the bearing area 14*a* against the partition 9 or of the upper end 12*b*-1 against the partition 9; in addition, a downwards force $f_2$ swings the front flat portion 12*a* downwards against the section $\mathbf{3}_1$ of the door 3. Thus, the partition 9 against which the upper end 12*b*-1 of the riser portion 12*b* or the surface 14*a* of the bearing block 14 comes into abutment resists the rearward retraction movements of the front flat portion 12*a* fixed to the upper end section $\mathbf{3}_1$ of the door 3.

More precisely, the horizontal components of the thrust forces $F_1$, $F_2$ and F3 in the direction XX' transferred to the upper end $\mathbf{3}_1$ of the door 3 at $\mathbf{3}_2$ are balanced by the opposing reaction of the partition where it contacts the bearing block 14 or the upper end 12*b*-1 of the riser portion 12*b*.

It may also be considered that there is an equilibrium in terms of the moments of forces transferred at the orifice 12*e* of the hinge part 11 relative to the pivot axis ZZ' located at the upper end 12*b*-1 of the part 12*b*. Thus, it should be understood that the height of the riser portion 12*b* contributes via a cantilever effect to providing resistance and rapid locking, stopping retraction of the upper portion $\mathbf{3}_1$ of the door 3 as soon as its inclination relative to the vertical exceeds a certain value, in particular 5°, or even 3°. In other words, the front flat portion 12*a* of the wedging part 12 cannot move back beyond a certain limited distance because pivoting of the position $\mathbf{3}_2$ at the upper end section $\mathbf{3}_1$ of the door 3 is blocked by abutment of the upper end 12*b*-1 against the partition.

In practice, the width in the direction ZZ' of the surface 14*a* of the bearing block 14 corresponds to approximately twice the width of the riser rod 12*b* and the dimension or height of the surface 14*a* in the direction is substantially equal to the width in the direction ZZ' of the riser portion 12*b*, such that the bearing area 14*a* is sufficient to avoid any possible crushing of the partition 9 that might occur if it is not sufficiently strong or rigid.

Furthermore, the weight of the bearing block 14 also contributes to increasing the thrust F1 against the partition by the horizontal component of the bearing weight 14 in the event of inclination of the riser portion 12*b*. The height or length of the riser portion 12*b* means that a relatively light bearing block 14 can be used, made of aluminum, that reduces the weight of the jacking device 10 and facilitates deployment and transport. In practice, the weight of the bearing block 14 is approximately 500 grams (g).

In the absence of a molding 9*a* and when the partition 9 is sufficiently strong and rigid, it is possible to dispense with positioning a bearing block 14, as can be seen in FIG. 7, because of the rigidity of the riser portion 12*b* and its length.

The rear face of the wedging device 12 comprises a striking block forming an anvil 13 that allows a mallet 10*a* to be used to strike its rear face 13*a* to cause the front flat portion 12*a* to be introduced into the slit 3*a*.

This anvil-forming striking block 13 is positioned above said rear flat portion 12*b* facing the rear face of the base 12*b*-2 of the riser portion 12*b*, the block 13 having a recess or notch in its underside in order to cover the rear flat portion 12*c* such that the rear face 13*a* of the anvil-forming striking block 13 is set back rearwardly in the direction XX' relative to the rear end of the rear flat portion 12*c*.

This block 13 can be dismantled since after being used several times, it may have deteriorated and thus need to be replaced.

The thrust device 1 shown in FIGS. 1A to 1C and 2 to 7 comprises a double-acting actuator comprising a cylindrical actuator body $\mathbf{4}_3$ comprising two movable rods $\mathbf{4}_1$, $\mathbf{4}_2$ that can exert thrusts oriented in mutually opposite directions. The ends of said movable rods $\mathbf{4}_1$, $\mathbf{4}_2$ on the outside of said cylindrical chamber are connected in hinged and detachable manner to said intermediate soleplate 6 and to said lower soleplate 5 respectively.

Said lower soleplate 5 includes a flat support $\mathbf{5}_1$ with the face that is intended to press against a lower jacking point 1, preferably the ground 20, and including non-slip elements, preferably hard tips $\mathbf{5}_2$, with the other face including the means $\mathbf{5}_3$ for hinging said actuator 4 on said lower soleplate 5.

Said upper jacking bar 7 is constituted by two telescopic tubes of length that can be adjusted by locking their relative position, in particular by an indexed lock cooperating with holes in the upper tube, the upper tube $\mathbf{7}_3$ sliding inside the lower tube.

The intermediate soleplate 6 includes a flat support $\mathbf{6}_1$ with a face that is intended to press against the external vertical planar surface of said door including non-slip elements constituted by hard tips $\mathbf{6}_2$ and the other face including means $\mathbf{6}_3$ for hinging said actuator 4 and said upper jacking bar 7.

The intermediate 6 and lower 5 soles include flat supports or platens $\mathbf{5}_1$, $\mathbf{6}_1$ and hinge means constituted by clevises $\mathbf{5}_3$, $\mathbf{6}_3$ on one face of each said flat supports $\mathbf{5}_1$, $\mathbf{6}_1$; retractable pins (not shown) forming hinge pins are detachably mounted on said clevises in holes in said lugs and said ends of said upper jacking bar 7 and/or said actuator 4, in order to hinge them on said soles 5, 6.

More particularly, a hole at the end of the first movable rod $\mathbf{4}_1$ of the hydraulic actuator cooperates with the holes in the lugs $\mathbf{6}_3$ of the intermediate soleplate 6 and a first retractable pin (not shown) inserted in said holes in the lugs and the end of said first movable rod $\mathbf{4}_1$ of the actuator, which means that said actuator is hinged to pivot about the axis constituted by said first pin, in particular when said intermediate soleplate 6 presses against a said door 3 and said actuator 4 is inclined in a position 20° to 35° to the vertical.

Similarly, a hole at the end of the second movable rod $\mathbf{4}_2$ of said actuator cooperates with the holes of the lugs $\mathbf{5}_3$ of the lower soleplate 5, and a second retractable pin (not shown) inserted in said holes in the lugs $\mathbf{5}_3$ of the lower soleplate 5 and the end of said movable second rod $\mathbf{4}_2$, which means that said actuator is pivotally hinged relative to the axis constituted by said second pin, especially when said lower soleplate 5 is positioned to press against the ground 1.

Similarly, a lower end hole of said jacking bar 7 cooperates with the holes in the lugs $\mathbf{6}_3$ of the intermediate soleplate 6 and a third retractable pin (not shown), inserted in said holes, which means that said upper jacking bar is pivotally hinged relative to the axis constituted by said third pin when said intermediate soleplate 6 presses against the door 3.

Clearly, these means for hinging of the actuator 4 and the jacking bar 7 relative to said soles 6, 5 are described purely by way of illustration; other hinge means may be employed without departing from the scope of the invention.

Said hydraulic actuator comprises an operating handle $\mathbf{8}_2$ and a transport handle $\mathbf{4}_4$.

The hydraulic actuator 4 is a single-acting actuator comprising a single flexible hose including the hydraulic fluid lines and the electrical connections $\mathbf{8}_1$. Said flexible hose $\mathbf{8}_1$ is connected to said actuator via an operating handle $\mathbf{8}_2$ the pivoting of which starts up the hydraulic power supply (not shown) at the end of the flexible hose. This method and device for controlling and supplying a hydraulic actuator have been described in French patent FR 94/07680 (published as FR 2 721 359). This handle $\mathbf{8}_2$, in combination with the flexible hose $\mathbf{8}_1$ connecting it to a source of hydraulic fluid, is an electrical connection between it and at least one switch, and is used:

- to control, by rotation of the handle $\mathbf{8}_2$, closing of said switch to start the fluid source, which is thus pressurized;
- to supply the chamber of said actuator located on the sides of the movable pistons moving the rods of the actuator through a flexible supply line $\mathbf{8}_1$ and said handle $\mathbf{8}_2$ connecting to said supply flexible line $\mathbf{8}_1$;
- to stop movement of the rod of the actuator and the source of pressurized fluid, releasing the handle that then returns to a neutral rest position;
- to open a return valve for fluid that has filled the chamber of the actuator by rotation of the handle in the direction opposite to that above; and
- to evacuate said fluid by bearing of an elastic means on the other side of the pistons that are then moved in the direction opposite to that above.

Preferably, the chamber of the actuator located on the other side of the piston relative to the chamber receiving said fluid under pressure is filled with compressed gas, which thus maintains a bearing pressure on the corresponding side of the piston. However, it is possible, without departing from the scope of the present invention, to use double-acting actuators with two flexible hydraulic fluid supply lines that may respectively supply actuation and return energy respectively for the movable rods.

Figure 2:
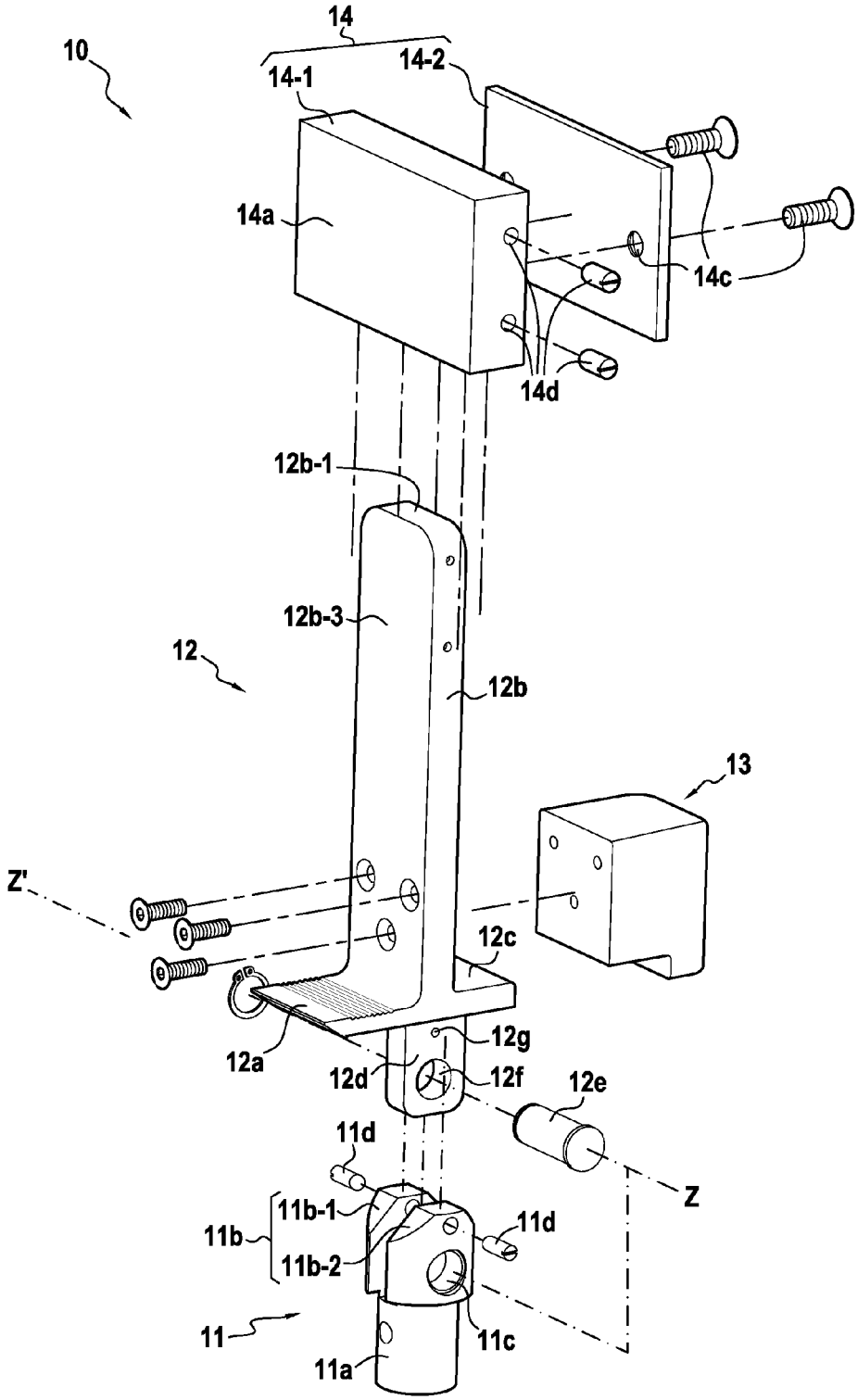
FIG. 2 represents an upper jacking device 10 intended to be fixed so as to be pivotally hinged on the upper end of the upper jacking bar 7 of a device as described in FIGS. 1A, 1B and 1C for adaptation to a pull door.
Figure 4B:
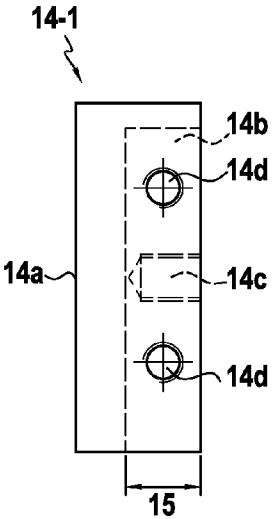
FIGS. 4A and 4B are rear and side views of the first portion 14-1 of the bearing part 14.
Figure 4A:
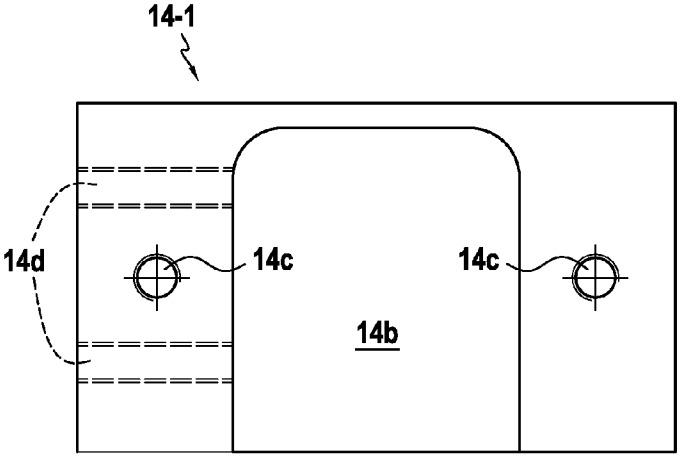
Figure 3:
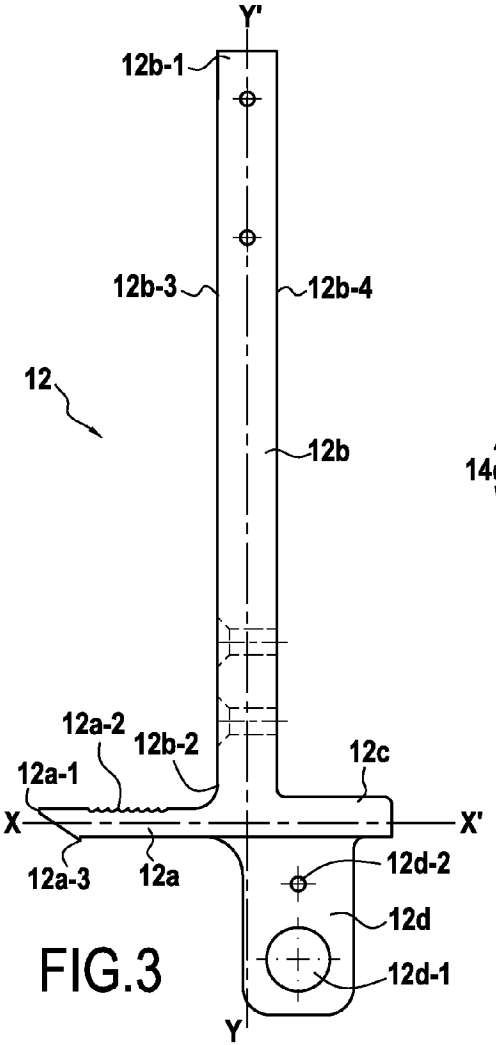
FIG. 3 is a side view of a wedging part 12.
Figure 5:
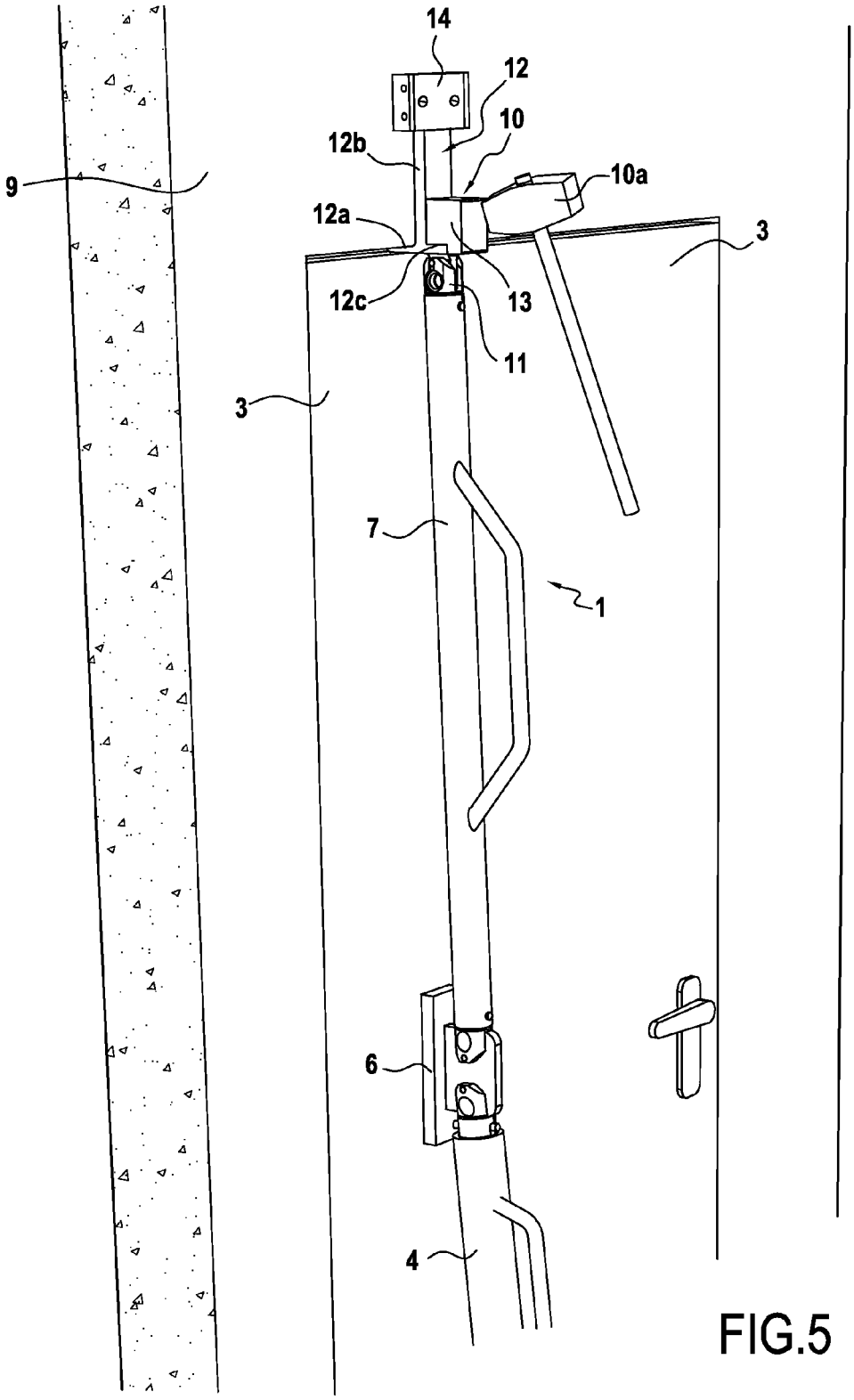
FIG. 5 is a perspective view of a thrust device of the invention, equipped with a jacking device 10 in the bearing position in the slit between the upper end of a door and the upper door frame before forcing.

To use the device of the invention as shown in FIGS. 1 and 2, the following steps are carried out, in which:

- the jacking device 10 is positioned to press against the slit 3*a* between the lintel of the frame 2 and the upper end of the door 3, said front flat portion 12*a* being forced as far as possible into said slit, such that the base 12*b*-2 of said riser portion 12*b* is abutting against the door frame 2 or a molding 9*a* facing the door frame 2; then
- the intermediate soleplate 6 is positioned to press against the door 3 around the lock $\mathbf{3}_1$; then
- the lower soleplate 5 of the hydraulic actuator 4 is positioned to press against the ground 1, the movable rods of the actuator 4 are deployed so that the actuator is at an inclination of approximately 30°. Once the device is in position, the adhesion elements constituted by the hard steel tips $\mathbf{6}_2$ and $\mathbf{5}_2$ of the intermediate 6 and lower 5 soles stabilize the device in its position.

Once the device is in position, the movable rods $\mathbf{4}_1$ and $\mathbf{4}_2$ of said actuator are extended to exert a thrust of at least 50 kN respectively on said intermediate 6 and lower soles 5.

A thrust is exerted on an armored door to force it to open by exerting a thrust on said intermediate soleplate 6 until the inclination of said actuator 4 increases by an angle of at least 3°, preferably by 5° to 20°. The actuator is deployed and transmits its load via the upper jacking bar 7 to the top of the door frame 2. The resistance offered by the upper jacking device 10 at the frame 2 and the partition 9 means that an optimized horizontal thrust can be obtained at the intermediate soleplate 6 so that the door can be opened.

The use of a hydraulic actuator has been described, but the actuator may also be pressurized via an electric, engine-driven, pneumatic, or manual pump.

For current security doors, in particular those provided with 3 or 5 closure points, it is observed that when the device is located around the locks, they release at a thrust from the actuator of more than approximately 50 kN as obtained with a hydraulic pressure of approximately 250 bar that creates an additional inclination of the actuator of 15°, as shown in FIG. 2. This operation, carried out in a few seconds, means that the actuator does not require a large amount of energy and may be operated with a hydraulic power supply not weighing more than 18 kilograms (kg) and suitable for fitting to a frame structure that can be carried on the back.

The invention claimed is:

1. A device for opening a door in a door frame by staving in the door, wherein the device can exert a thrust on a vertical surface of the door and stave in the door when the device is positioned against the door on the side to which the door opens by being pulled, the device comprising:

an actuator, an intermediate soleplate, and an upper jacking bar;

said actuator comprising a movable rod with one end hingedly fixed on said intermediate sole plate; and said upper jacking bar being hingedly fixed on said by one end thereof to said intermediate soleplate;

an upper jacking device hingedly fixed to the upper end of said upper jacking bar, said upper jacking device comprising at least one wedging and locking part forming:

a front fiat portion that can be introduced into a slit between the doer frame and the upper end of the door; and a riser portion extending in a longitudinal direction YY' perpendicular to and above said front flat portion, the upper end of said riser portion being intended to face a partition above the door frame; and a rear portion located at the base of and behind said riser portion, at the underside of which a fixing element is capable of allowing pivotal hinging of said wedging and locking part relative to the upper end of said jacking bar.

2. The device according to claim 1, wherein the upper end of said riser portion of the wedging part comprises a bearing part having a bearing surface extending in a plane YY', ZZ' perpendicular to the upper and lower faces of said front flat portion and can come into contact with and press against the vertical partition above the door frame, when said front flat portion is inserted horizontally and forced as far as possible into said slit between the upper end of the door and the door frame, said bearing surface having a dimension that is greater than the surface of the upper portion of said riser portion, on which said bearing part is fixed.

3. The device according to claim 2, wherein said bearing surface is located vertically in front of said riser portion such that only said bearing surface is in contact with the partition above the door frame when said front flat portion is inserted horizontally into said slit.

4. The device according to claim 2, wherein said bearing part can be fixed to the upper end of said riser portion in two different positions, wherein the distance between said bearing surface and the front face of said riser portion is different, the two said positions corresponding to inversion of the faces constituting the front face and rear face of said bearing part relative to the upper end of said riser part on which said hearing part is fixed.

5. The device according to claim 1, wherein said front flat portion comprises:

a front end comprising an underside beveled at an angle of approximately 30°, facilitating insertion of said front flat portion into said slit; and an upper grooved or corrugated face, said grooves or corrugations being inclined rearwardly; and a lower face comprising at least one corrugation or a portion in the form of a rearwardly inclined hook.

6. The device according to claim 1, wherein said wedging and locking part comprises a striking part in the form of a block constituting an anvil located at the base of said riser portion, at least partially above said rear flat portion, said anvil-forming striking part being detachably fixed on said wedging and locking part.

7. The device according to claim 1, wherein said front flat portion and said riser portion of the said wedging and locking part have the same dimension in a direction ZZ' perpendicular to said longitudinal direction YY' of said riser portion.

8. The device according to claim 1, further comprising:

a lower soleplate, the other end of said actuator being fixed in hinged manner to said lower soleplate; and said actuator is a double-acting actuator comprising an actuator body constituted by a cylindrical chamber comprising two movable rods that can exert thrusts oriented in opposite directions to each other, the ends of said movable rods on the external side of said cylindrical chamber being fixed in hinged manner to said intermediate and lower soleplates respectively; and said upper jacking bar is adjustable in length constituted by two telescopic tubes, the length of said jacking bar being adjustable by locking the relative position of said telescopic tubes; and said intermediate soleplate comprises a flat support one face of which, which is intended to press against said door or vertical planar surface, comprises non-slip elements and the other face of which comprises means for fixing in a hinged manner said actuator and said upper jacking bar.

9. A device according to claim 1, further comprising:

a hydraulic power supply delivering a pressure, mounted on a frame structure that can be carried on the back of an operator; and said hydraulic power supply being connected to a single-acting hydraulic actuator via a handle that can control opening and closing of supply and return hydraulic fluid valves of said single-acting hydraulic actuator.

10. A method of exerting a thrust on a pull door, wherein the device according to claim 1 is used and the following steps are carried out:

1) said front flat portion is inserted in a slit between the upper end of the door and the door frame, forcing said front flat portion in as far as possible until the base of said riser portion abuts against the door frame or a molding facing the door frame; and 2) said actuator is disposed with an inclination relative to the vertical, with said intermediate soleplate pressing against the vertical planar surface of said door;

said actuator pressing against a lower external jacking point; and 3) the movable rod of said actuator is extended so as to exert said thrust on said intermediate soleplate until the inclination of said actuator is increased by an angle of at least 3°.

11. The device according to claim 1, wherein said riser portion extends over a length equal to at least three times the dimension of said front flat portion in the direction XX' perpendicular to said longitudinal direction YY' of said riser portion, and said rear portion being a rear flat portion extends in a direction XX' perpendicular to said longitudinal direction YY' of said riser portion.

12. The device according to claim 1, wherein said fixations in each manner are detachable fixations.

* * * * *